United States Patent [19]

Peterson

[11] 4,039,240

[45] Aug. 2, 1977

[54] ELECTRICAL CONNECTOR AND CONTACTS THEREFOR

[75] Inventor: Carl W. Peterson, Santa Ana, Calif.

[73] Assignee: International Telephone and Telegraph Corporation, New York, N.Y.

[21] Appl. No.: 641,095

[22] Filed: Dec. 15, 1975

Related U.S. Application Data

[60] Division of Ser. No. 527,600, Nov. 27, 1974, Pat. No. 3,955,873, which is a continuation-in-part of Ser. No. 510,382, Sept. 30, 1974, abandoned.

[51] Int. Cl.[2] ..... H01R 13/38

[52] U.S. Cl. ..... 339/99 R; 339/100

[58] Field of Search ..... 339/97–99, 339/100

[56] References Cited

U.S. PATENT DOCUMENTS 3,964,816 6/1976 Narozny ..... 339/99 R

*Primary Examiner*—Joseph H. McGlynn

*Attorney, Agent, or Firm*—Thomas L. Peterson

[57] ABSTRACT

A multicontact electrical connector comprising a two-piece connector housing in which electrical contacts are mounted within one of the housing sections. The rearward ends of the contacts are provided with slotted tubular termination sections which are adapted to receive insulated wires to form electrical and mechanical connections between the contacts and the wires. The second section of the housing functions as a tool which forcibly inserts the wires into the termination sections of the contacts at an acute angle. A plurality of wires may be connected to the contacts simultaneously at a work site without the necessity of any special tool or fixture. The termination sections of the contacts may be utilized for terminating flat cables as well as insulated round wires.

7 Claims, 20 Drawing Figures

ELECTRICAL CONNECTOR AND CONTACTS THEREFOR

This is a division, of U.S. Pat. No. 3,955,873 application Ser. No. 527,600, filed Nov. 27, 1974, which is a continuation-in-part of application Ser. No. 510,382, filed Sept. 30, 1974, abandoned.

BACKGROUND OF THE INVENTION

This invention relates generally to an electrical connector and, more particularly, to an improved arrangement for terminating conductors to contacts in an electrical connector.

Crimping techniques are commonly utilized for securing contacts to insulated wires. In accordance with such techniques, the wire end must be stripped of its insulation covering and the contact barrel is then crimped onto the bare wire. Subsequently, the contact is inserted into a contact receiving cavity in a housing of an electrical connector. The contacts are usually individually removable from the contact receiving cavities so that a damaged contact can be replaced. The crimping of individual contacts is obviously time consuming. Moreover, crimping generally cannot be performed on contacts which are already mounted in a connector housing since it is impractical to design crimping tools which are capable of crimping the end of the contact to a wire due to the common use of a large nunber of contacts with closely spaced centers. Thus, what is desired is a termination system which requires no crimping of contacts.

Termination techniques are known in the art in which conductors are connected to contacts without crimping. Such devices are normally referred to as "solderless" connectors. The following U.S. Pat. Nos. disclose various forms of solderless connectors: 3,012,219; 3,234,498; 3,617,983; 3,683,319; 3,718,888; 3,758,935; 3,760,335; and 3,761,886. Each of these patents discloses a plate-like section having slots adapted to receive an insulated wire which is pushed into the slot at right angles with respect to the plate. While such an arrangement may be convenient for certain electrical interconnection systems, it has not been practically applied to electrical connectors utilized in the telephone industry, for example, except in the aforementioned U.S. Pat. No. 3,760,335 to Roberts. In the Roberts patent, the plate-like sections which receive the wires are disposed at right angles to the longitudinal axis of the contacts so that when the wires are inserted into the slots in the plate-like sections, the wires will extend rearwardly from the connector generally parallel to the contacts. In this manner, the large number of wires connected to the contacts in the connector may be gathered together and passed through a strain relief clamp on a junction shell of the connector in the conventional manner. The insertion of the wires into the plate-like termination sections of the contacts in the Roberts patent is performed by a special fixture disclosed therein. The connector is first fixedly mounted in the fixture. A plurality of wires is then inserted into slots on a pair of pivoted arms which are shifted into position adjacent to the plate-like sections of the contacts to appropriately locate the wires for insertion into the slots in the plate-like sections. Thereafter, a pair of handles are pivoted to transfer the wires from the pivot arms into the slots in the contact termination sections. While the contact termination arrangement disclosed in the Roberts patent is satisfactory, it requires a special fixture to perform the termination procedure. In addition, the use of plate-like termination sections on the contacts limits the extent to which the contacts may be mounted in closely adjacent relationship in the connector housing. Further, the termination arrangement is essentially limited to use with round wires and is not capable for use with flat cables, for example.

It is the purpose of the present invention to overcome the attendant disadvantages of the prior art connector termination arrangements by providing a termination device which requires little space, thereby allowing contacts in a connector to have closely spaced centers, and which is adapted to a variety of forms of conductors, including both round wires and flat cables. Another purpose of the ivention is to provide a connector in which a part of the connector housing is utilized as a tool for simultaneously inserting a plurality of wires into the termination sections of the contacts in the connector, thus eliminating the necessity of a special fixture for performing the termination procedure.

SUMMARY OF THE INVENTION

According to the principal aspect of the present invention, there is provided an electrical connector having an insulative housing including first and second sections. A plurality of contacts are mounted in the first section of the housing. Each contact has a termination section of tubular configuration. The tubular termination section is formed with a pair of longitudinally extending conductor receiving slots on opposite sides thereof. These slots extend to the rear of the termination section. One of the slots extends completely through the termination section thereby providing a pair of arcuate resilient side walls. The second section of the housing embodies means for forcibly inserting portions of insulated conductors simultaneously into the slots in the termination sections of the contacts. The conductors are preferably inserted at an acute angle with respect to the longitudinal axes of the termination sections whereby the conductors may be easily directed rearwardly from the connector through an outlet in a junction shell of the connector, for example. The second section of the housing therefore functions as the tool for inserting the wires into the termination sections of the contacts. Thus, no special fixture is required for terminating the contacts to the wires. Inserting the wires at an acute angle to the termination sections of the contacts has the advantage of providing a larger contact area between the contact and the wire and a wiping action which assures an effective electrical connection. In addition, the improved termination construction of the present invention provides stain relief in the case of round type of wire terminations. The termination arrangement may also be utilized for terminating flat cables or the like. The use of tubular termination arrangements also permits the use of more closely spaced contact centers than when flat slotted termination structures are utilized such as in the prior art discussed hereinabove. Other objects and advantages of the invention will become more apparent from the following description taken in connection with the accompanying drawings.

DESCRIPTION OF THE PREFERRED EMBODIMENTS

Figure 1:
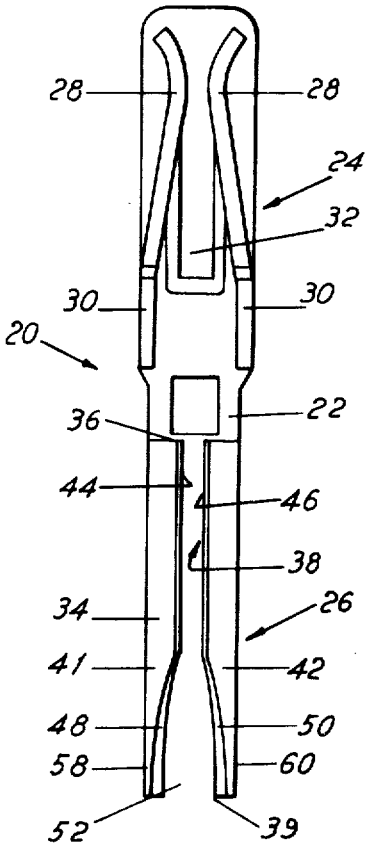
FIG. 1 is a front view of a contact embodying the novel termination structure of the present invention.
Figure 2:
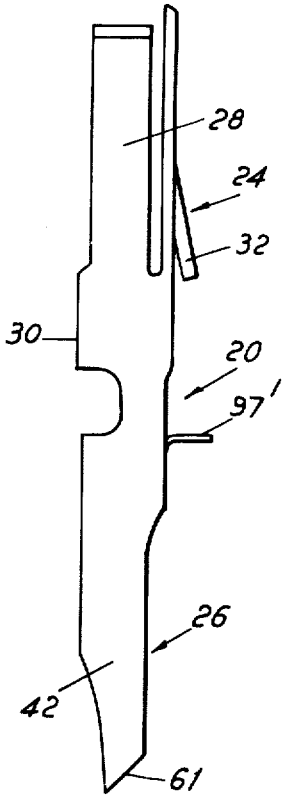
FIG. 2 is a side view of the contact illustrated in FIG. 1.
Figure 3:
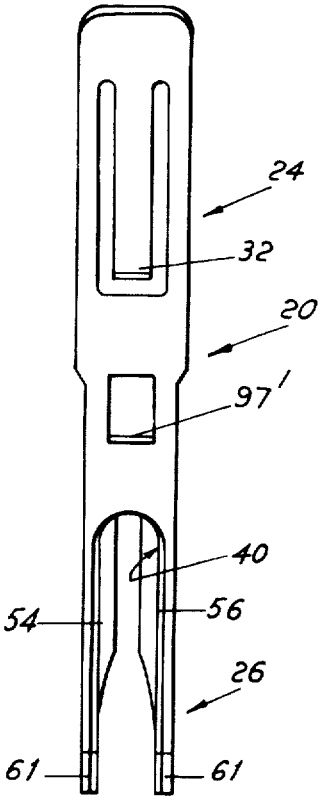
FIG. 3 is a rear view of the contact illustrated in FIG. 1.

Referring now to the drawings in detail, FIGS. 1-8 illustrate a contact, generally designated 20, which embodies the novel termination structure of the present invention. The contact has a generally flat base portion 22 with a forward contacting portion 24 thereon and a rear termination section 26. The forward contacting portion includes a pair of bowed spring contact members 28 each integrally connected to the base portion 22 by an upwardly bent flange 30. A resilient retention finger 32 is stamped out from the base portion 22 essentially intermediate the spring contact members 23. It should be understood that the forward contacting portion 24 of the contact 20 constitutes no part of the present invention and may take any form as desired.

The rear termination section 26 of the contact comprises a generally tubular section 34 having its front end 36 adjacent to and integrally joined to the base portion 22. A slot 38 extends longitudinally through the tubular section 34 from the front end 36 to the rear end 39 thereof. This slot is on the side of the tubular section opposite to the base portion 22. A second slot 40 is provided in the tubular section 34 on the side thereof opposite to the first slot 38. The second slot 40 extends from the rear end 39 of the tubular section forwardly but short of the front end 36.

The first slot 38 which extends the entire length of the tubular section 34 divides that section into a pair of resilient arcuate side walls 41 and 42 having longitudinally extending spaced edges 44 and 46, respectively, defined by the slot. The resilient side walls 41 and 42 provide a spring action which causes the edges 44 and 46 to make electrical connection to a conductor, which will be described in detail later. The second shorter slot 40 also results in a spring action being produced on the opposite side of the termination section 26 for strain relief of the conductor.

The forward portions of the edges 44 and 46 adjacent to the front end 36 of the termination section 26 are uniformly spaced from each other while the rear portions of the edges diverge outwardly at 48 and 50 to the rear end 39 of the rear section providing a conductor entrance area 52.

Figure 4:
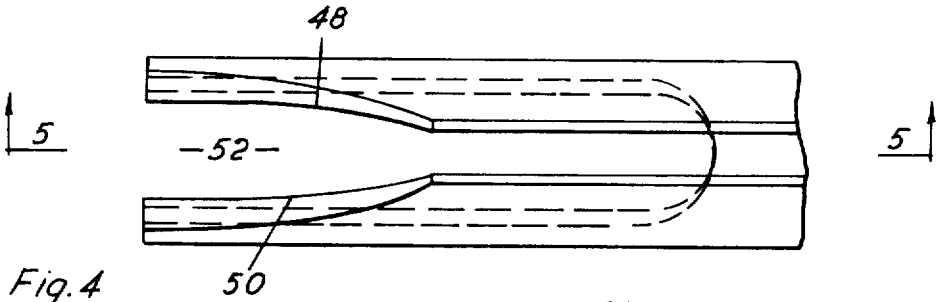
FIG. 4 is a substantially enlarged fragmentary view of the contact illustrated in FIG. 1 showing the details of structure of the termination section thereof.
Figure 6:
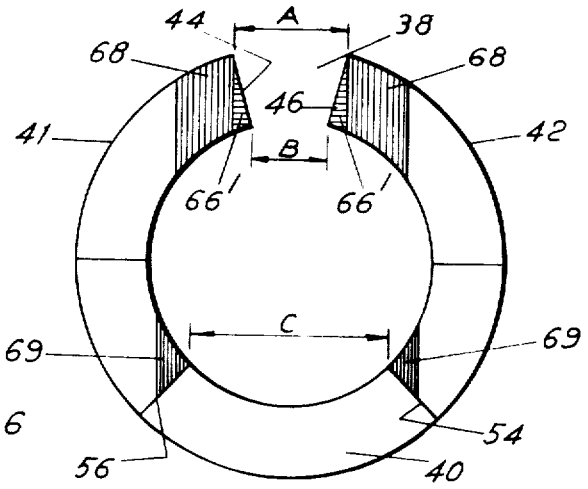
FIG. 6 is an end view of the termination section of the contact illustrated in FIGS. 4 and 5 with the shaded areas representing the regions of wire and insulation piercing.

As best seen in FIG. 6, the edges 44 and 46 of the arcuate side walls 41 and 42 of the termination section of the contact extend radially while the rear outwardly diverging edges 48 and 50 have a tapered arcuate configuration, seen in FIG. 4. The tapered arcuate edges 48 and 50 commence from the radially extending edges 44 and 46 and taper rearwardly into a generally flat plane parallel to the plane of the relatively flat base portion 22 of the contact. Thus, the edges 44, 46, 48 and 50 provide cutting edges for a conductor.

The slot 40 on the opposite side of the tubular section 34 of the contact provides a pair of uniformly spaced edges 54 and 56 which are spaced apart a distance greater than the edges 44 and 46. The edges 54 and 56 extend radially as seen in FIG. 6 to also provide cutting edges.

The two slots 38 and 40 define a pair of legs 58 and 60 at the rear of the termination section of the contact. Preferably the ends of these legs are chamfered as indicated at 61 in FIG. 2 to provide piercing barbs for flat cable insulation when the contacts are utilized for terminating the conductors of a flat cable. This will be more fully explained in connection with the embodiment illustrated in FIGS. 17 and 18.

Most conveniently, the contact 20 is provided by cutting a blank from a sheet of resilient metal and forming the same into the desired configuration as illustrated in the drawings. The tubular section 34 is illustrated as having a cylindrical configuration. However, it will be appreciated that the tubular section may have a cross section of different configuration, such as elliptical.

Figure 5:
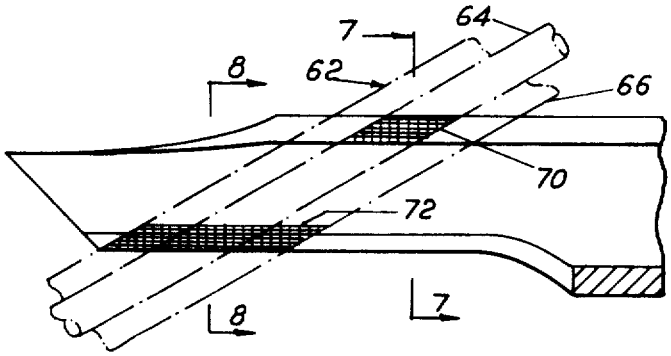
FIG. 5 is a sectional view taken along line 5—5 of FIG. 4 with an insulated conductor mounted therein, shown in phantom, with the shaded areas showing the wire and insulation contact regions of the termination section.

The configuration of the rear termination section 26 of the contact in accordance with the present invention is designed so as to permit a conductor 62 to be inserted into the termination section of the contact at an acute angle with respect to the axis of the tubular section of the contact. FIG. 5 illustrates the conductor 62 in phantom connected to the termination section of the contact to clearly show the contact regions between the cutting edges of the termination section and the conductor. The conductor comprises a core 64 which may be a single or multiple round wire strand which is covered by insulation 66. Prior to describing the details of how the conductor is terminated to the contact, reference is made to FIG. 6 for the purpose of describing the dimensional relationships between the cutting edges of the termination section of the contact and the conductor. The maximum dimension between the edges 44 and 46 designated by the arrow A in FIG. 6 is approximately equal to the diameter of the core 64 of the conductor. The minimum dimension between the edges 44 and 46 indicated by the arrow B in FIG. 6 is less than the diameter of the core 64. The shaded regions 66 of the termination section of the contact illustrated in FIG. 6 represent the regions of the contact which penetrate into the core of the conductor. The cross-hatched regions 68 of the contact termination section illustrated in FIG. 6 represent the regions which slice through and become embedded within the insulation covering 66 of the conductor 62. The minimum dimension between the edges 54 and 56 indicated by the arrow C in FIG. 6 is greater than the diameter of the core 64 but less than the diameter of the insulation covering on the core. The shaded regions 69 in FIG. 6 indicate those regions which penetrate into the insulation covering 66 when the conductor 62 is inserted into the slots in the termination device.

Figure 7:
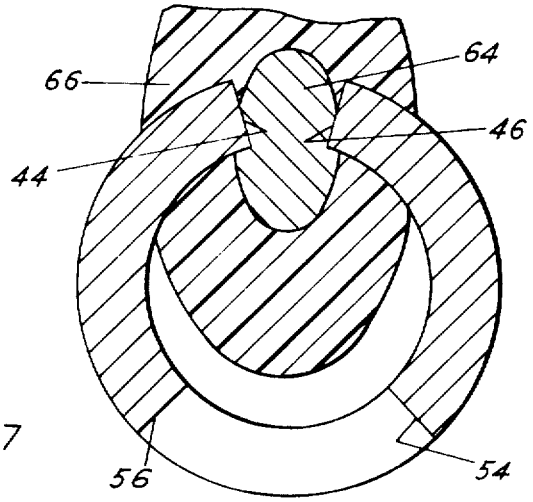
FIG. 7 is a sectional view taken along line 7—7 of FIG. 5 showing how the contact termination section severs the insulation on a conductor at one region and penetrates the wire core.
Figure 8:
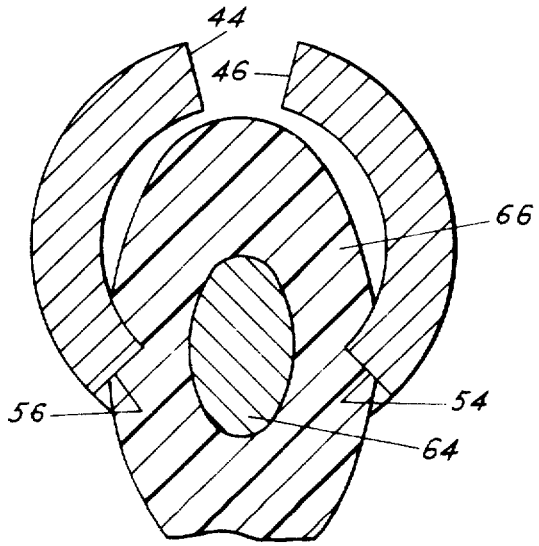
FIG. 8 is a sectional view taken along line 8—8 of FIG. 5 illustrating how the termination section of the contact penetrates the conductor insulation at a second region providing strain relief for the conductor.

When the conductor is forced into the slots in the termination section of the contact at an acute angle, as illustrated in FIG. 5, the tapered arcuate cutting edges 48 and 50 bordering the conductor entrance 52 gradually cut and peel the insulation from the wire core. Further forward movement of the conductor into the slot 38 causes the cutting edges 44 and 46 to penetrate the core 64 of the conductor, as seen in FIG. 7. During the forward movement of the conductor into the slots, the cutting edges 54 and 56 penetrate the insulation 66 at a second region of the conductor, but do not penetrate the inner core, thereby providing strain relief for the conductor at an area behind the electrical and mechanical interconnection between the core and the cutting edges 44 and 46. The upper shaded area 70 in FIG. 5 indicates the area of contact between the core 64 and the edges 44 and 46 of the tubular termination section 34, while the lower shaded area 72 indicates the contact area between the conductor insulation and the edges 54 and 56. It is apparent that these two contact areas are greater than if the conductor were inserted into the slots 38 and 40 at a right angle to the longitudinal axis of the tubular section 34. The arcuate side walls 41 and 42 of the tubular section 34 possess an inherent spring action which assures a good mechanical and electrical interconnection between the conductor and the contact. The angle at which the conductor is inserted into the termination section of the contact is not critical. Preferably the angle of insertion is approxiately 30° with respect to the axis of the tubular section 34. Obviously this angle could be altered as desired. In fact, the conductor could be inserted at a right angle with respect to the axis of the tubular section if desired. The provision of a tubular termination section on the contact 20 has the advantage that the contact may be terminated to smaller wires with closer center to center spacing than flat plate solderless termination devices as in the prior art. While the termination arrangement of the present invention has been described herein as being particularly useful for round conductors covered by insulation, it obviously could be utilized for terminating to bare conductors, flat conductors, flat conductor-flat cable, round conductor-flat cable, etch flex circuit and etch printed circuit boards. The versatility of the termination construction of the present invention will become more apparent in connection with the description of the embodiments illustrated in FIGS. 15–18.

Figure 9:
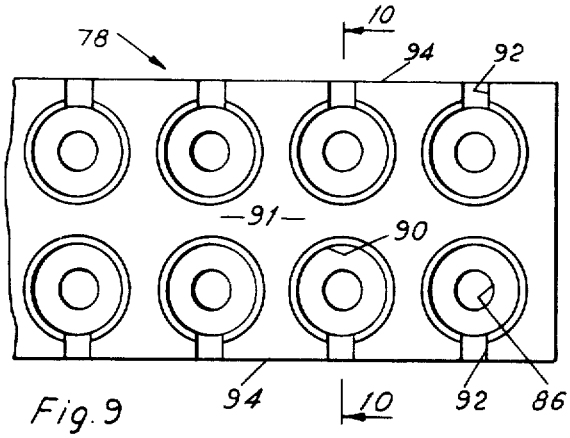
FIG. 9 is a rear view of the front section of the housing employed in the connector of the present invention.
Figure 10:
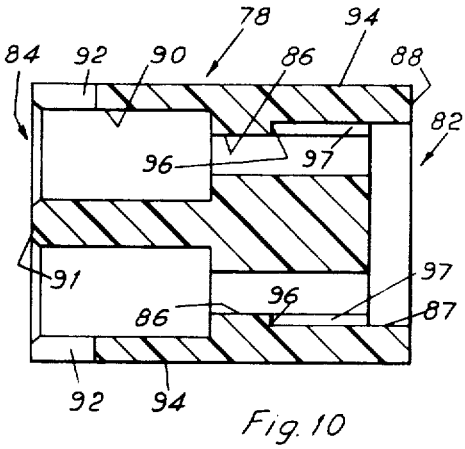
FIG. 10 is a vertical sectional view taken along line 10—10 of FIG. 9.

Reference is now made to FIGS. 9–14 of the drawings, which illustrate an electrical connector incorporating the contact 20. The connector is shown assembled in FIG. 14 and includes an insulative housing 76 having a front section 78 and a rear section 80. The two sections may be securely held together by integral latching means formed thereon (not shown). The front housing section 78 has a mating side 82 and a conductor receiving side 84. Two rows of contact cavities 86 extend from the mating side 82 of the housing section 78 to the conductor receiving side 84. These cavities comprise cylindrical bores which are disposed in parallel relationship with each other. The cavities in the two rows of cavities are aligned with each other as best seen in FIG. 9. A recess 87 is formed in the front face 88 of the housing section 78. The contact cavities open into the recess. Counter bores 90 extend from the cavities 86 to the rear face 91 of the front section 78. Slots 92 are cut in the sides 94 of the section 78 aligned with and communicating to the bores 90.

Figure 14:
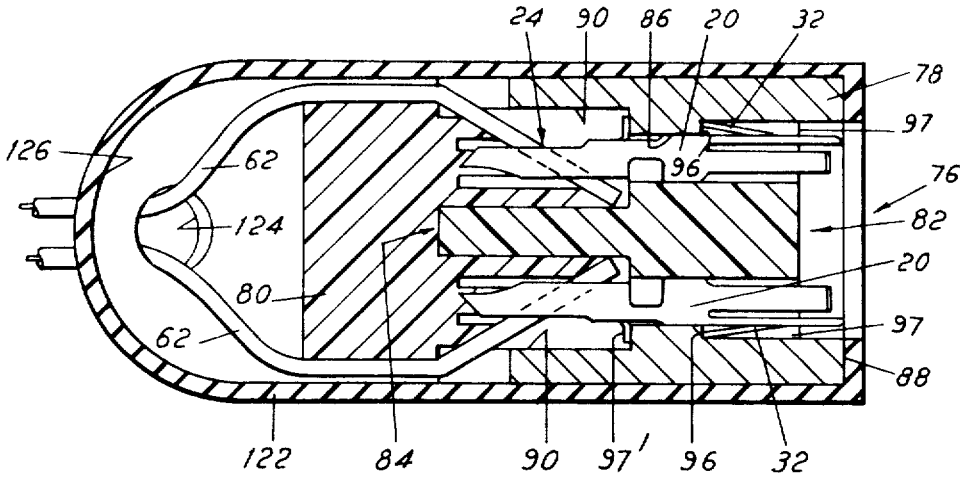
FIG. 14 is a vertical sectional view through the connector housing of the present invention showing the rear section of the housing mounted onto the front section, with two contacts being shown terminated to conductors and the housing mounted in a junction shell.

As best seen in FIG. 14, contacts 20 are mounted in each of the cavities 86 in the front housing section 78. The retention line 32 of each contact engages the bottom 96 of a slot 97 formed in the wall of the cavity 86 to restrain the contact against rearward movement in the insulator. Each contact has a tab 97′ cut out of its flat base portion 22 which engages the bottom of the counter bore 90 to limit forward movement of the contact into the cavity 86. The forward contacting portion 24 of each contact extends beyond the front face 88 of the housing for connection to mating contacts of a second electrical connector member, not shown. The contacts 20 in each row of cavities 86 are arranged so that their slots 38 lie in a common plane along the row with the slots of one row of contacts facing the slots 38 in the other row of contacts. Hence, the spring contact members 28 of one row face the spring contact members in the other row. As seen in FIG. 14, the rear termination sections 26 of the contacts are coaxially positioned within the counter bores 90 of the housing section 78 defining annular spaces 96 therebetween in the counter bores.

Figure 12:
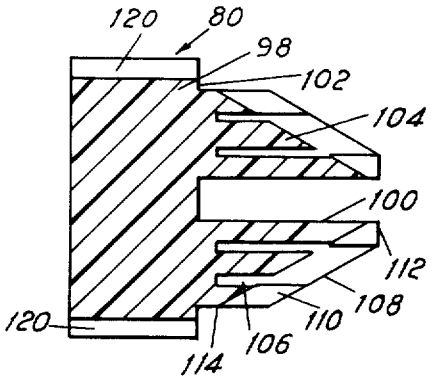
FIG. 12 is a vertical sectional view taken along line 12—12 of FIG. 11.
Figure 11:
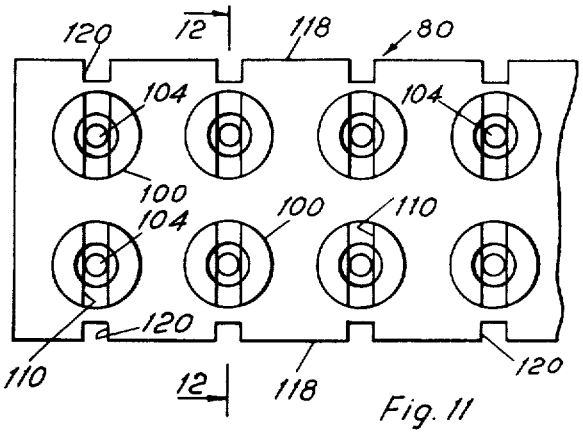
FIG. 11 is a front view of the rear section of the connector housing which is utilized as the tool for inserting conductors into the contacts mounted in the front section of the housing.
Figure 13:
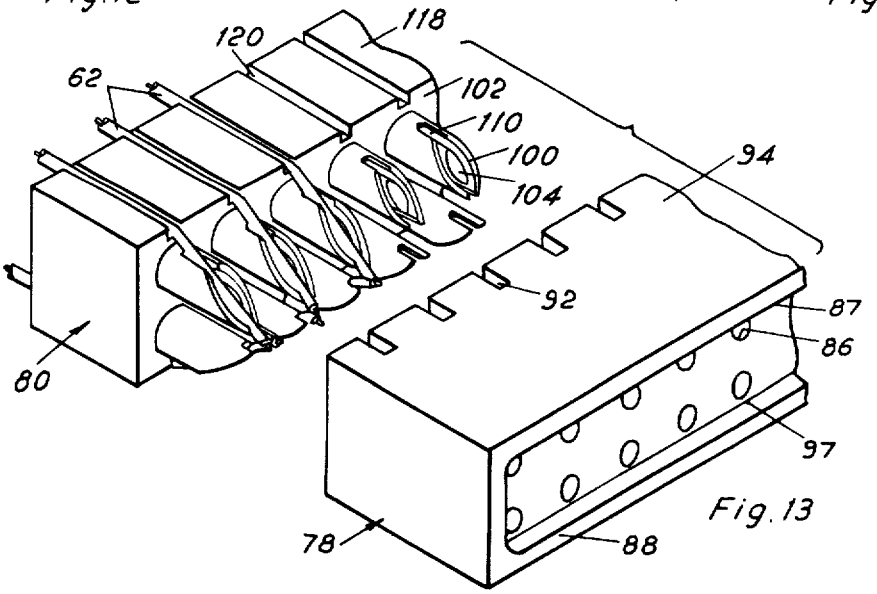
FIG. 13 is a perspective exploded view of the front and rear sections of the connector housing with a number of wires shown mounted in position on the rear section of the housing prior to insertion into contacts in the front section.

The rear section 80 of the connector housing functions as the tool for inserting the conductors into the termination ends of the contacts. As best seen in FIGS. 11 and 12, the rear section 80 comprises a base 98 having two rows of elongated hollow cylindrical members 100 mounted on the forward face 102 thereof. The hollow members 100 are positioned in the same pattern as the contact cavities 86. The outer diameter of each hollow member 100 is slightly less than the diameter of each counter bore 90 so that the hollow members may be slidably received into the counter bores. An integral cylindrical pin 104 is concentrically mounted within each hollow member 100 and spaced from the wall thereof to provide an annular space 106. The inside diameter of each hollow member is slightly greater than the outside diameter of the tubular section 34 of a corresponding contact 20 and the outside diameter of the pin 104 is slightly less than the inner diameter of the tubular section. Therefore, when the hollow cylindrical member 100 is inserted within a counter bore 90 in the front housing section 78, the tubular section 34 of the contact mounted in such bore will slide into the space 106.

The front end of each hollow member 100 is chamfered to provide an inclined front face 108 which corresponds to the acute angle at which it is desired to insert an insulated conductor into the termination end of a contact. The inclined front faces 108 of each row of hollow members 100 lie in a common plane. The front faces of one row of hollow members face in the opposite direction as the front faces in the other row. As a consequence, the slots 38 in the tubular sections 34 of the contacts in each row of contacts are reversed with respect to the direction at which the inclined front faces 108 of the hollow members face.

A slot 110 is formed across the front face 108 of each hollow member 100. Each slot extends from the forward portion 112 of the hollow member to the rearward portion 114 thereof. Each slot is dimensioned to snugly receive the conductor 62 therein. The forward end of each pin 104 is chamfered so as to lie in the same plane as the bottom 116 of the slot 110. Thus, the forward portion 112 of the inclined front face 108 of each hollow member is generally aligned with the slot 38 in the termination section of its corresponding contact 20 while the rearward portion 114 of the front face is generally aligned with the slot 40 in the contact.

The base 98 of the rear insulator 80 has a pair of parallel sides 118 which are disposed behind and rearward of the hollow members 100. A row of parallel grooves 120 are formed in each of the sides 118 aligned with the slots 110 in the individual hollow member 100. These grooves are also dimensioned to snugly receive a conductor 62.

It will be appreciated that by virtue of the matched orientation of the hollow members 100 and the counter bores 90 in the housing sections 78 and 80, respectively, the rear section 80 is mounted on the front section by relative movement therebetween in a path parallel to the axis of the contact cavities. The hollow cylindrical members 100 slide into the counter bores 90 thereby serving to mount the rear housing section 80 to the conductor receiving side of the front housing section 78. FIG. 14 illustrates the two housing sections mounted together in this manner and disposed within a junction shell 122 which may be formed of either metal or plastic. The junction shell has an opening 124 in a rear wall 126 for receiving the conductors 62 connected to the contacts 20 in the connector housing. A strain relief clamp, not shown, may be mounted on the outside of the junction shell 122 surrounding the opening 124.

In order to assemble the connector, initially the contacts 20 are inserted into the cavities 86 in the front housing section 78 from the conductor receiving side 84. The retention tines 32 will deflect inwardly when the forward portions 24 of the contacts are inserted into the cavities and will then spring outwardly as illustrated in FIG. 14 after passing the bottom 96 of the recess 86 to limit rearward movement of the contacts in their respective cavities. Thereafter a plurality of insulated conductors 62 are mounted in the aligned grooves and slots 120 and 110, respectively, with the ends of the conductors extending a short distance beyond the forward ends 112 of the hollow members 100. The slots and grooves are dimensioned to snugly receive the conductors 62 so that the conductors will remain attached to the rear housing section 80. That section is then moved forward toward the conductor receiver side 84 of the front section 78 so that the hollow members 100 will slide into the counter bores 90 and the annular spaces 106 in the hollow members will slidably receive the tubular sections 34 of the contacts. The forward portion 112 and rearward portion 114 of each hollow member engages a conductor 62 opposite sides of the termination section 26 of a contact while the central pin 104 engages an intermediate region of the conductor inside the termination section, providing three-point conductor engagement for effectively inserting the conductor into the slots 38 and 40.

Since the slots 100 holding the conductors are disposed at an acute angle, the conductors will be inserted into the slots 38 and 40 at such angle, causing the cutting edges of the termination section of the contact to sever the insulation covering and penetrate the wire core, as explained before in connection with FIGS. 5–8. It is noted that portions of the conductors extend into the slots 92 in the conductor receiving side 84 of the front housing section 70 when the two housing sections are fully assembled together. Cutting edges 44 and 46 of each contact termination section produce a relatively large and effective electrical and mechanical interconnection with the conduct core while the cutting edges 54 and 56 partially pierce the insulation coverting 66 to provide strain relief for the conductor. Thus a portion of the connector housing acts to locate and hold the conductors to be terminated. The rear section 80 of the housing could be removed but preferably it is retained interconnected with the front section 78, as illustrated in FIG. 14. The conductors extend rearwardly through grooves 120 generally parallel to the axes of the contacts and pass outwardly through the opening 124 in the junction shell 122 where they may be secured by a strain relief clamp as well known in the art.

It will be appreciated from the foregoing that by the present invention a special tool or fixture is not required to terminate contacts to conductors. A portion of the connector housing itself constitutes the tool. It will also be appreciated that contacts of different form may be utilized embodying the rear termination section 26 of the present invention. Such contacts may be mounted in different forms of insulators, as well as in planar mounting boards such as printed circuit boards. The contacts may be arranged in any suitable pattern and not necessarily in straight rows. In those cases, a tool may be utilized having either a single pin 104 and a hollow cylindrical member 100 assembly or a plurality of such assemblies arranges in the particular pattern of the contacts. Thus, another novel feature of the present invention is the construction of a tool per se for inserting conductors at an acute angle into contacts embodying the novel rear termination structure 26 described herein.

Figure 15:
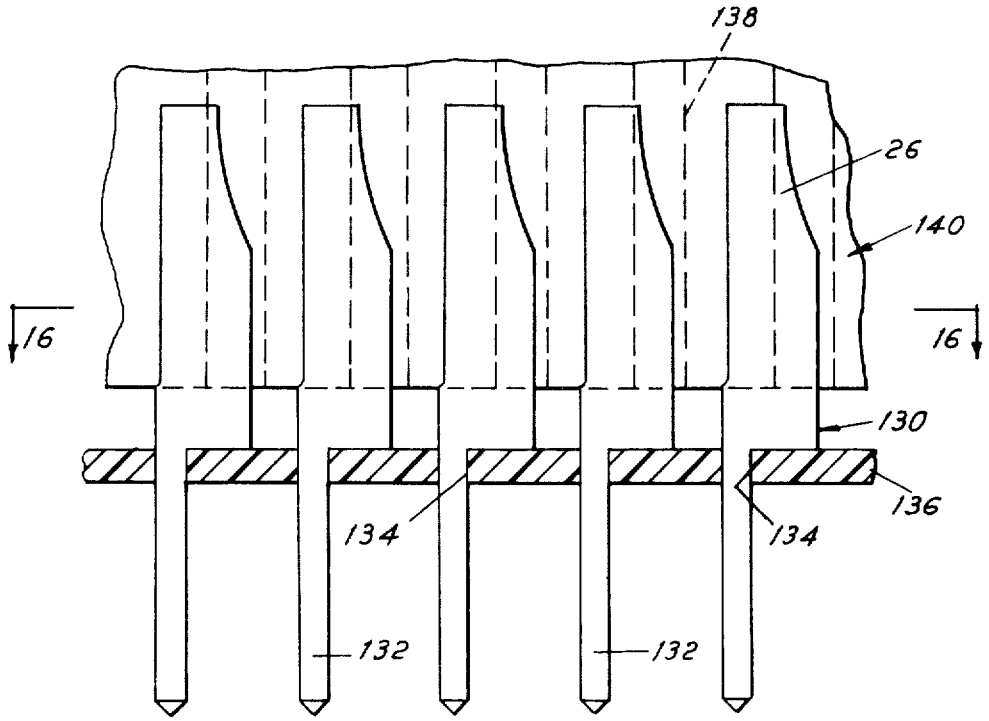
FIG. 15 illustrates another embodiment of the invention wherein contacts are mounted on a printed circuit board and are terminated to a flat cable having flat conductors, with the flat cable disposed in a vertical plane.
Figure 16:
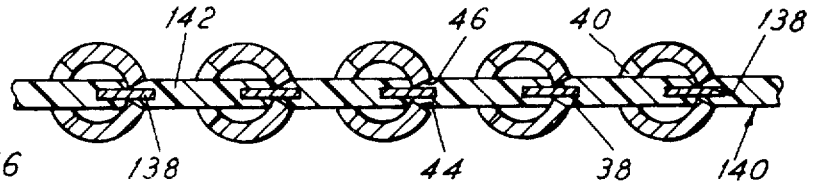
FIG. 16 is a horizontal sectional view taken along line 16—16 of FIG. 15.

FIGS. 15–16 illustrate another embodiment of the invention in which the contacts 130 are shown as having mounting tails 132 inserted into holes 134 in planar mounting member 136, such as a printed circuit board. Each contact 130 embodies a rear termination section 26 as described hereinbefore. The contacts 130 are arranged in a row with the slots 38 and 40 in the termination sections 126 lying in a common plane as seen in FIG. 16. By this arrangement, the contacts may be terminated to flat conductors 138 of a flat cable 140 inserted in a vertical plane into the slots 38 and 40. In this arrangement, only the cutting edges 44 and 46 pierce the insulation 142 of the flat cable and penetrate into the conductors 138. The slots 140 provide a clearance area for the insulation of the flat cable between the conductors.

Figure 17:
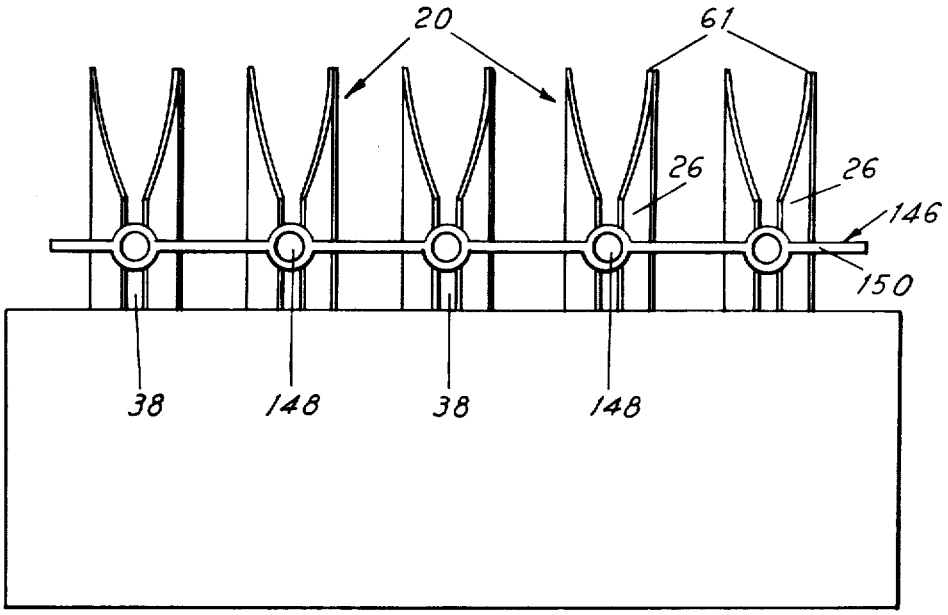
FIG. 17 illustrates an additional embodiment of the invention wherein the termination sections of a plurality of contacts are exposed outside of a housing and are terminated to a flat cable disposed in a horizontal plane.
Figure 18:
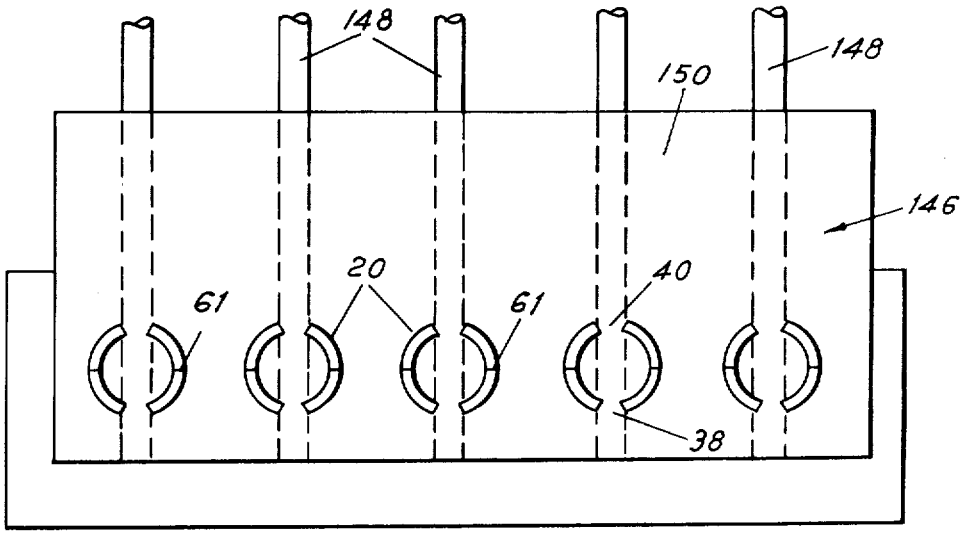
FIG. 18 is a top plan view of the arrangement illustrated in FIG. 17.
Figure 20:
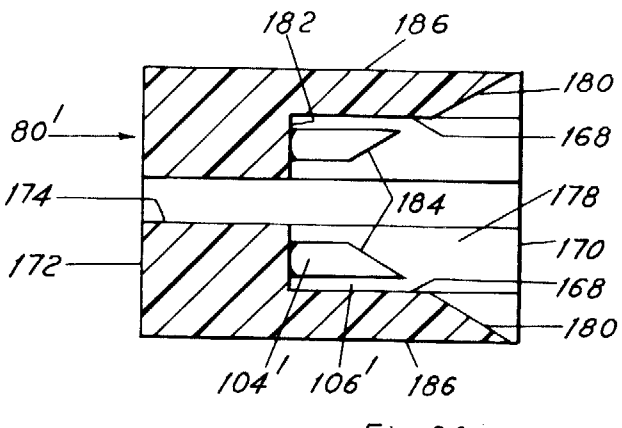
FIG. 20 is a vertical sectional view taken along line 20-20 of FIG. 19.
Figure 19:
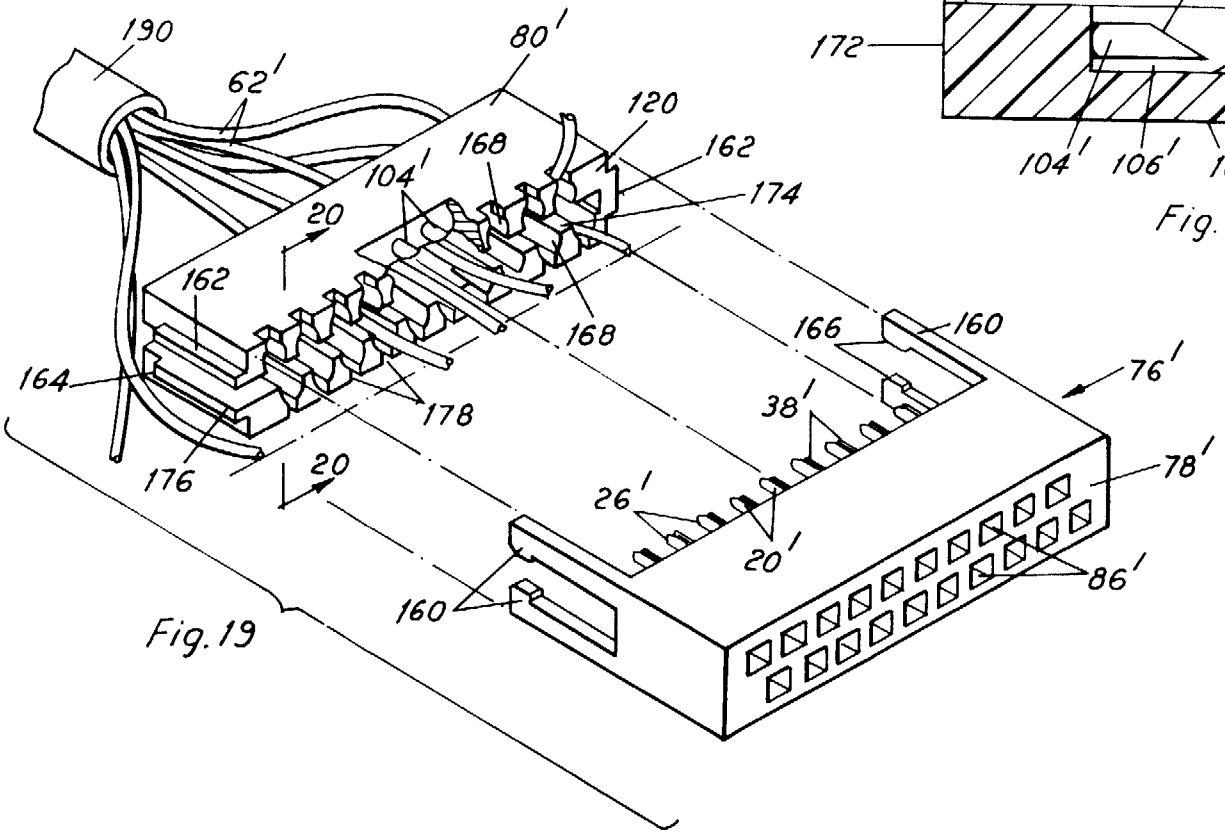
FIG. 19 is a perspective exploded view of a further embodiment of the invention similar to that illustrated in FIGS. 9-14.

Another flat cable termination arrangement is illustrated in FIGS. 17 and 18. In this arrangement, the contacts may be of the same form as the contact 20 with the rear termination sections 26 thereof arranged in a row with the slots 38 on one side and the slots 40 on the other. In this embodiment, a flat cable 146 having round conductors 148, is disposed in a horizontal plane and pushed downwardly with the conductors aligned with the respective slots 38 and 40 in the termination sections of the contacts. By such downward movement, the piercing barbs 61 at the ends of the termination sections of the contacts cut though the insulation 150 of the flat cable and the round conductors 148 are forced into the slots 38 providing electrical and mechanical connection between the conductors and the contacts. It will be appreciated that in both the embodiments illustrated in FIGS. 15–16 and FIGS. 17–18, the tool illustrated in FIG. 12 is not employed. The flat cables may be simply pushed into the termination ends of the contacts manually. In the embodiment illustrated in FIGS. 17–18, a comb-like tool (not shown) will facilitate the termination procedure. The teeth of the comb would be arranged to extend into the slots in the terminal sections of the contacts as well as between the contacts.

From the foregoing, it is seen that the termination structure of the contact of the present invention is very versatile, allowing termination to a wide variety of electrical conductors. Furthermore, in the preferred form of the invention illustrated in FIGS. 1–14, a portion of the connector housing itself constitutes the tool for inserting the conductors into the termination ends of the contacts, thus eliminating the necessity of any special tooling at a work site. The invention permits the rapid and simple termination of contacts to a large number of conductors simultaneously. The tubular configuration arrangement also allows the use of smaller wires and closer center-to-center spacing of the contacts.

What is claimed is:

1. A terminal device connected to an electrical conductor having a core covered by insulation, said terminal device comprising:

a base portion having a generally tubular section at one end thereof, said tubular section having a front end adjacent to said base portion and an opposite rear end;

a first slot extending longitudinally through said tubular section from said front end to said rear end defining a pair of resilient arcuate side walls;

the edges of said side walls defined by said slot being uniformly spaced from each other adjacent to said front end, said edges diverging outwardly to said rear end portion an entrance for said conductor;

the distance between said uniformly spaced edges being less than the cross-section of said core;

a second slot in said tubular section on the side thereof opposite to said first slot and extending from said rear end toward but short of said front end, the edges of said tubular section defined by said second slot being uniformly spaced from each other, the distance between said second-mentioned edges being less than the cross-section of said conductor but greater than the cross-section of said core; and said conductor being forcibly inserted into said slots at an acute angle with respect to the longitudinal axis of said tubular section, the said first-mentioned edges severing said insulation and penetrating said core at a forward region of the conductor and said second-mentioned edges penetrating said insulation at a second region of said conductor immediately behind said forward region providing strain relief for said conductor, the portion of said conductor behind said second region thereof extending generally parallel to said axis.

2. A terminal device as set forth in claim 1 wherein: said edges extend generally radially with respect to said axis.

3. A terminal device as set forth in claim 1 wherein: said outwardly converging edges have a tapered arcuate configuration.

4. A terminal device as set forth in claim 1 wherein: said first and second slots form a pair of legs, the rear of said legs being chamfered to provide piercing barbs for flat cable insulation.

5. A terminal device as set forth in claim 1 including an integral bowed contact on said base portion at the other end thereof.

6. An electrical connection assembly for a flat cable having flat conductors covered by insulation comprising:

an insulator;

a plurality of contacts mounted in a row in said insulator spaced apart a distance corresponding to the spacing of said conductors, each said contact having a termination section extending outwardly from a surface of said insulator;

said termination section of each said contact having a tubular configuration, said tubular termination section having a pair of longitudinally extending slots therein on opposite sides thereof each extending to the end of said termination section remote from said surface, one of said slots extending to the other end of said termination section providing a pair of arcuate resilient side walls;

said contacts being oriented with the slots therein lying in a common plane providing a continuous slot for receiving the end of a flat cable therein coplanar with said plane; and the edges of the resilient side walls defined by one of said slots of each contact being spaced apart a distance less than the thickness of the flat cable conductor for slicing through the insulation and penetrating said conductor.

7. An electrical connector assembly connected to a flat cable having flat conductors covered by insulation, said assembly comprising:

an insulator;

a plurality of contacts mounted in a row in said insulator spaced apart a distance corresponding to the spacing of said conductors, each said contact having a termination section extending outwardly from a surface of said insulator;

said termination section of each said contact having a tubular configuration, said tubular termination section having a pair of longitudinally extending slots therein on opposite sides thereof each extending to the end of said termination section remote from said surfaces, one of said slots extending to the other end of said termination section providing a pair of arcuate resilient side walls;

said contacts being oriented with the slots therein lying in a common plane providing a continuous slot, said continuous slot receiving the end of said cable therein coplanar with said plane; and the edges of the resilient side walls defined by one of said slots of each contact being spaced apart a distance less than the thickness of the flat cable conductor, said edges of said contacts slicing through said insulation and penetrating said conductors.

* * * * *